US008526855B2

(12) United States Patent
Kobashi et al.

(10) Patent No.: US 8,526,855 B2
(45) Date of Patent: Sep. 3, 2013

(54) IMAGE FORMING APPARATUS AND IMAGE FORMING METHOD

(75) Inventors: Masaru Kobashi, Matsumoto (JP); Yoichi Yamada, Shiojiri (JP); Koji Migita, Matsumoto (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 610 days.

(21) Appl. No.: 12/498,216

(22) Filed: Jul. 6, 2009

(65) Prior Publication Data

US 2010/0008699 A1 Jan. 14, 2010

(30) Foreign Application Priority Data

Jul. 14, 2008 (JP) ..... 2008-182265

(51) Int. Cl.
*G03G 21/00* (2006.01)

(52) U.S. Cl.
USPC ..... 399/129; 399/50; 399/71; 399/349

(58) Field of Classification Search
USPC ..... 399/50, 71, 129, 349
See application file for complete search history.

(56) References Cited

U.S. PATENT DOCUMENTS

| | | | | |
|---|---|---|---|---|
| 2005/0191099 | A1* | 9/2005 | Yamaguchi et al. | 399/346 |
| 2007/0212139 | A1* | 9/2007 | Sugiura et al. | 399/353 |
| 2008/0002997 | A1* | 1/2008 | Watanabe et al. | 399/35 |

FOREIGN PATENT DOCUMENTS

| | | | |
|---|---|---|---|
| JP | 04-275569 | | 10/1992 |
| JP | 04275569 | A | 10/1992 |
| JP | 05-241484 | | 9/1993 |
| JP | 09114338 | A | 5/1997 |
| JP | 09-251264 | | 9/1997 |
| JP | 2001-109350 | | 4/2001 |
| JP | 2004-101659 | | 4/2004 |
| JP | 2004-239999 | | 8/2004 |
| JP | 2005266354 | A | 9/2005 |
| JP | 2006-267733 | | 10/2006 |

* cited by examiner

*Primary Examiner* — Walter L Lindsay, Jr.
*Assistant Examiner* — Benjamin Schmitt
(74) *Attorney, Agent, or Firm* — DLA Piper LLP (US)

(57) ABSTRACT

An image forming apparatus includes: an image carrier; an exposure device; a developing device that develops the latent image on the image carrier by using a toner charged to a predetermined polarity and having an external additive; a transfer device that transfers a toner image developed on the image carrier to a transfer medium; a first charging member that charges the external additive and the transfer residual toner remaining on the image carrier and the image carrier after transfer to the same polarity as a polarity of the toner; a cleaning member that electrostatically attracts the external additive and the transfer residual toner charged by the first charging member; and a second charging member that charges the image carrier to an electric potential smaller in absolute value than an electric potential of the image carrier generated after the image carrier passes the cleaning member.

9 Claims, 6 Drawing Sheets

METHOD OF MEASURING ELECTRIC POTENTIAL OF EXTERNAL ADDITIVE

IMAGE FORMING APPARATUS AND IMAGE FORMING METHOD

BACKGROUND

1. Technical Field

The present invention relates to an image forming apparatus having an electrophotographic device, such as an electrostatic copier, a printer, or a facsimile, and an image forming method capable of suppressing so-called ghost (sometimes, it is called memory. Hereinafter, it is referred to as "external-additive memory") caused by an external additive remaining after transfer.

2. Related Art

Generally, image forming apparatuses have been contrived which suppress ozone generation at the time of the charging of a photosensitive body and prevent deterioration of the photosensitive body caused by discharge products (for example, refer to Japanese Unexamined Patent Application Publication No. H04-275569). In the image forming apparatus disclosed in Japanese Unexamined Patent Application Publication No. H04-275569, the photosensitive body is largely negatively charged by a charging brush after transfer, and a positive corona charging is performed by corona charger, thereby adjusting the electric potential of the photosensitive body to a predetermined negatively charged potential.

Further, image forming apparatuses using toners with small particle diameters have been also contrived which are configured to clean a photosensitive body by removing external additive and residual toner after transfer (for example, refer to Japanese Unexamined Patent Application Publication No. 2004-101659). In the image forming apparatus disclosed in Japanese Unexamined Patent Application Publication No. 2004-101659, the photosensitive body is largely negatively charged by a brush roller after transfer, thereby adjusting the charge polarities of the residual toner and the external additive which are not adjusted after transfer. In addition, the residual toner and the external additive are collected by a second brush roller to which a bias for attracting those has been applied.

In the image forming apparatus disclosed in Japanese Unexamined Patent Application Publication No. H04-275569, the transfer residual toner is removed in a cleaning section, but some of the external additive having a small particle diameter is not removed, and passes the cleaning section. The external additive is largely negatively charged when the photosensitive body has been negatively charged by using the charging brush. Hence, when the surface potential of the photosensitive body is adjusted by positive corona charging, the electric potential of the external additive is adjusted to be positively charged. However, some of the external additive, which is still negatively charged, remains amongst the external additive which have been adjusted to be positively charged. The reason is that, in the case of the negatively charged toner, an external additive having a high negative charging property is mixed with the toner in order to adjust the quantity of charge of the toner, and all the external additive having a high negative charging property are not positively charged even after undergoing the positive corona charging. In addition, the negatively charged external additive has an electrostatically repulsive interaction with the negatively charged toner, but since the quantity of charge of the external additive is significantly larger than that of toner base particles, the external additive electrostatically polarizes and attracts the toner base particles. Accordingly, the negatively charged external additive attracts the negatively charged toner in the developing area, thereby causing the external-additive memory.

In the image forming apparatus disclosed in Japanese Unexamined Patent Application Publication No. 2004-101659, some external additive coming into contact with the brush bristles of the second brush roller becomes high-charged external additive with a high negative charge, but some external additive which does not come into contact with the brush bristles becomes low-charged external additive with a slight negative charge. The high-charged external additive is attached to the brush bristles, and is collected by the collecting roller which comes into contact with the brush bristles. However, the low-charged external additive is not attached to the brush bristles and has a small particle diameter, and thus passes the second brush roller. For this reason, the negatively charged external additive attracts the negatively charged toner in the developing area as described above, thereby causing the external-additive memory.

SUMMARY

An advantage of some aspects of the invention is to provide an image forming apparatus and an image forming method capable of suppressing the occurrence of the external-additive memory by using external additive which remains in the image carrier after transfer.

In order to solve the above-mentioned problems, the image forming apparatus and the image forming method according to aspects of the invention is configured as follows. An external additive and a transfer residual toner are highly charged to the same polarity as the polarity of a toner by a first charging member. The high-charged external additive, which is relatively highly charged to the same polarity as that of the toner and the transfer residual toner charged as described above, are electrostatically attracted and removed by a cleaning member. The low-charged external additive, which is relatively slightly charged and not removed by the cleaning member, is charged to about 0 electric potential or a small positive potential by a second charging member. In such a manner, the low-charged external additive having passed the second charging member has low adhesion force to the toner, and scarcely attracts the toner in the developing area. As a result, it is possible to prevent occurrence of external-additive memory in the developing process and to obtain stably high image quality.

In the image forming apparatus and the image forming method according to this aspect of the invention, a photosensitive body 2 is charged by applying only a DC voltage bias. In such a manner, it is possible to suppress the deterioration and shaving of the image carrier caused by the image carrier charging in the first charging member.

In the image forming apparatus and the image forming method according to this aspect of the invention, a charging brush roller is used in any one of the first charger member and the cleaning member. Accordingly, it is possible to suppress the shaving of the image carrier caused by the image carrier charging in the first charging member and to suppress the shaving of the image carrier caused by the image carrier cleaning by the cleaning member. As a result, it is possible to effectively realize the long durability of the image carrier and to obtain stably high image quality for a long period of time.

In addition, in the image forming apparatus and the image forming method according to this aspect of the invention, the image carrier is highly charged to the same polarity as the toner by mainly using the first charging member, and the charge of the image carrier is controlled by the electric potential having a polarity opposite to that of the toner by using the second charging member as an auxiliary so that the electric potential of the image carrier is reduced in absolute value and made uniform. In addition, in order to make the electric potential of the image carrier uniform, a corona charger may be used. Even in this case, since the change in charging potential thereof is small, it is possible to reduce the current of a charge wire, and thus it is possible to suppress ozone production. In particular, a corona discharge having a positive polarity opposite to the toner can be performed by the corona charger. In such a manner, it is possible to perform uniform corona discharge since the deterioration of the charge wire is small when compared with the case where negative corona discharge is performed because of a difference in corona generation principal. As a result, it is possible to effectively achieve long durability of the second charging member and to obtain stably high image quality for a long period of time.

In addition, the image carrier, the transfer residual toner and external additive are highly charged to the same polarity as the toner by the first charging member. At this time, the high-charged external additive and the transfer residual toner are removed by a second brush roller. In such a manner, a first brush roller of the first charging member is used as a cleaner and as a charging brush for charging the toner and the external additive. By the dual use of the brush roller as described above, it is possible to achieve lower costs and space savings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the accompanying drawings.

Figure 1:
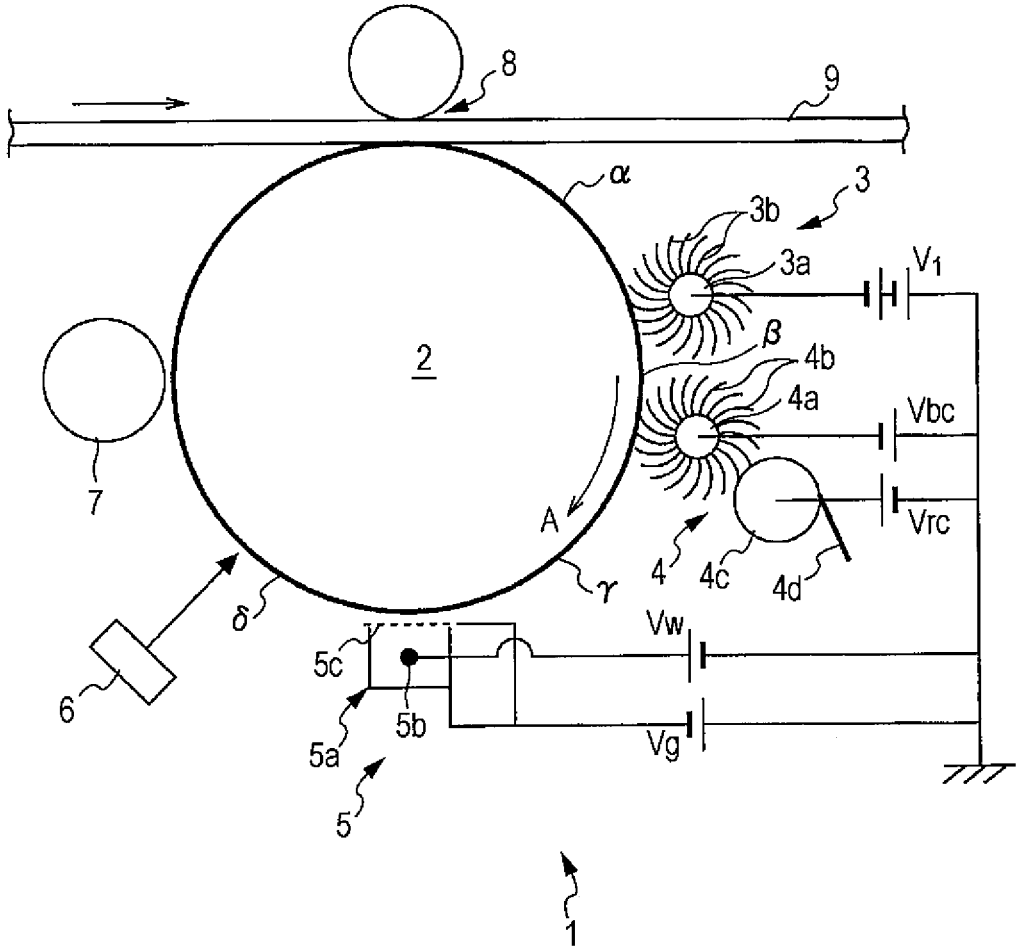
FIG. 1 is a diagram schematically and partially illustrating an example of an image forming apparatus according to an embodiment of the invention.

FIG. 1 is a diagram schematically and partially illustrating an example of an image forming apparatus according to an embodiment of the invention.

In the image forming apparatus 1 of the example, image formation is performed by using the negatively charged toner. The image formation may also be performed by using the positively charged toner. In the following description, it will be described that a negatively charged toner is used in the image forming apparatus 1. However, a positively charged toner may be used if only electric potentials of charging of the members to be described later are set to have opposite polarities. In addition, a toner has toner base particles and an external additive added to the toner base particles, but in the following description, the toner base particles are simply referred to as a toner.

As shown in FIG. 1, the image forming apparatus 1 has a photosensitive body 2 as an image carrier on which an electrostatic latent image and a toner image are formed. The photosensitive body 2 is formed from a photosensitive drum, and a photosensitive layer having a predetermined film thickness is formed on the outer peripheral surface of a metallic tube having cylindrical shape similarly to an existing photosensitive drum. In the metallic tube in the photosensitive body 2, for example, a conductive tube made of aluminum and the like is used, and an existing organic photosensitive body is used in the photosensitive layer.

The photosensitive body 2 includes a first charger 3, a cleaner 4, a second charger 5 (which corresponds to the second charging member according to the aspect of the invention), an exposure device 6, a developing device 7, and a transfer device 8 which are arranged on the circumference thereof in this order in a rotational direction A (in FIG. 1, a clockwise direction) around the photosensitive body 2.

The first charger 3 has a first brush roller 3*a* (which corresponds to a first charging member according to the aspect of the invention) which is formed so that it may rotate. The first brush roller 3*a* has a plurality of brush bristles 3*b*, and these brush bristles 3*b* are arranged near to or in abutting contact with the surface of the photosensitive body 2. The first brush roller 3*a* is adapted to rotate in a direction (a direction at the time when the advance direction of the photosensitive body 2 tangential to rotation thereof at an abutting portion of the photosensitive body 2 and the brush bristles 3*b* is the same as the advance direction of the brush bristles 3*b* tangential to rotation thereof) the same as the rotation direction of the photosensitive body 2 or in a direction (a direction at the time when the advance direction of the photosensitive body 2 is opposite to the advance direction of the brush bristles 3*b*) opposite to the rotation direction of the photosensitive body 2.

An existing charging brush roller which has been used hitherto is used as the first brush roller 3*a*. As an example of the first brush roller 3*a*, the brush bristles 3*b* has the following specifications: the material is 6 nylon; the fineness is 220 T/96 F; the density is 240 kf/inch$^2$; the resistance of the original yarn is 7.1 LogΩ; the length of the pile is 5 mm; and the length of the first brush roller 3*a* in an axial direction to the photosensitive body 2 is 300 mm. A brush roller manufactured by TOEISANGYO CO., LTD can be used as the first brush roller 3*a*.

A first charging bias $V_1$ (V) of the direct current (DC) of a relatively strong negative polarity (that is, the same polarity as the toner used in the development process) is applied to the first brush roller 3*a*. In such a manner, the surface of the photosensitive body 2 after the termination of the transfer process is charged to a relatively high negative potential. In addition, the charge polarities of the transfer residual toner and external additive remaining on the surface of the photosensitive body 2 are not made to be uniform. However, these transfer residual toner and external additive are negatively charged at the same time when the photosensitive body 2 is negatively charged. In this case, even when the transfer residual toner and external additive are positively charged, the electric potentials of those are small in absolute value, and thus those are sure to be negatively charged.

In addition, if only the first charger 3 is a charger capable of relatively highly charging the photosensitive body 2 to a negative polarity, the charger does not have to rotate. In the first charger 3, a simple charging brush deck, a charging rubber, a corona charger, a charging film, and the like may be used instead of the first brush roller 3*a*.

The cleaner 4 has a second brush roller 4*a* (which corresponds to a cleaning member according to the aspect of the invention) which is formed so that it may rotate. The second brush roller 4*a* has a plurality of brush bristles 4*b*, and these brush bristles 4*b* are arranged so as to be in abutting contact with the surface of the photosensitive body 2. The second brush roller 4*a* is adapted to rotate in a direction (a direction at the time when the advance direction of the photosensitive body 2 tangential to rotation thereof at an abutting portion of the photosensitive body 2 and the brush bristles 4*b* is the same as the advance direction of the brush bristles 4*b* tangential to rotation thereof) the same as the rotation direction of the photosensitive body 2 or in a direction (a. direction at the time when the advance direction of the photosensitive body 2 is opposite to an advance direction of the brush bristles 4*b*) opposite to the rotation direction of the photosensitive body 2. A brush roller which is the same as the above-mentioned first brush roller 3*a* may be used as the second brush roller 4*a*.

A cleaning bias Vbc (V) of the negative direct current (DC) for attracting the toner and the external additive charged by the first charger 3 is applied to the second brush roller 4*a*. Here, $V_1$ (V) is defined as the first charging bias, and Vth (V) is defined as the discharge start voltage between the first brush roller 3*a* and the photosensitive body 2. Under this definition, the cleaning bias Vbc (V) satisfies the relationship of $|V_1|>|Vbc|>(|V_1|-Vth)$. In this case, the cleaning bias Vbc (V) is set as a bias having a magnitude which does not cause discharge between the brush bristles 4*b* and the surface of the photosensitive body 2, that is, which does not exceed the discharge limit. By applying the cleaning bias Vbc (V) to the second brush roller 4*a*, an electric field is generated between the photosensitive body 2 and the second brush roller 4*a*. Thereby, the second brush roller 4*a* electrostatically attracts the transfer residual toner and the high-charged external additive which have high negative charge out of the transfer residual toner and external additive which remain on the surface of the photosensitive body 2 after the transfer process is terminated and are charged by the first charger 3. Then, the attracted toner and external additive adhere to the brush bristles 4*b*. In addition, instead of the brush roller, a rubber roller may be used as the cleaner 4.

In addition, the cleaner 4 has a collecting roller 4*c* which is formed so that it may rotate. The collecting roller 4*c* is disposed so as to be in abutting contact with the brush bristles 4*b* of the second brush roller 4*a*. The collecting roller 4*c* is adapted to rotate in a direction the same as the rotation direction of the second brush roller 4*a* (similarly to the above description).

A collecting bias Vrc (V), which generates a positive electric field opposite to that of the toner, is applied to the collecting roller 4*c* in order to electrostatically attract the toner and the external additive adhered to the brush bristles 4*b* of the second brush roller 4*a*. Then, by applying the collecting bias Vrc (V) to the collecting roller 4*c*, the collecting roller 4*c* electrostatically attracts the toner and external additive, which adhere to the brush bristles 4*b* of the second brush roller 4*a*. In such a manner, the attracted toner and external additive adhere to the collecting roller 4*c*. An existing cleaning roller may be used as the collecting roller 4*c*.

In addition, the cleaner 4 has a cleaning blade 4*d* which comes into contact with the collecting roller 4*c*. The cleaning blade 4*d* collects the toner and external additive adhered to the collecting roller 4*c* by scrapping it off the collecting roller 4*c*. An existing cleaning blade may be used as the cleaning blade 4*d*.

The second charger 5 has a corona charger 5*a* which does not come into contact with the surface of the photosensitive body 2. A scorotron charger having a charge wire 5*b* and a grid 5*c* is used in the corona charger 5*a*. An existing scorotron charger may be used as the scorotron charger. A wire charging bias Vw (V) of positive direct current (DC) is applied to the charge wire 5*b* of the scorotron charger, and a grid charging bias Vg (V) of negative direct current (DC) is applied to the grid 5*c*. In such a manner, the corona charger 5*a* charges the photosensitive body 2 with corona discharge of a positive polarity (which is opposite to that of the toner). Thus, the electric potential of the surface of the photosensitive body 2 is lowered and made uniform, and the photosensitive body surface potential is set to an electric potential $V_0$ (V) set at the time of image formation.

In addition, instead of the corona charger 5*a*, a roller charger and the like which comes into contact with the photosensitive body 2 may be used as the second charger 5. In addition, the scorotron charger may be used. In this case, in order to realize uniform charging, a wire charging bias Vw (V), in which an AC voltage is superimposed on a positive DC voltage, may be applied to the charge wire 5*b*.

An existing exposure device, an existing developing device, and an existing transfer device may be respectively used as the exposure device 6, the developing device 7, and the transfer device 8.

Next, an operation (an image forming method) of the image forming apparatus 1 of the example will be described.

Figure 2:
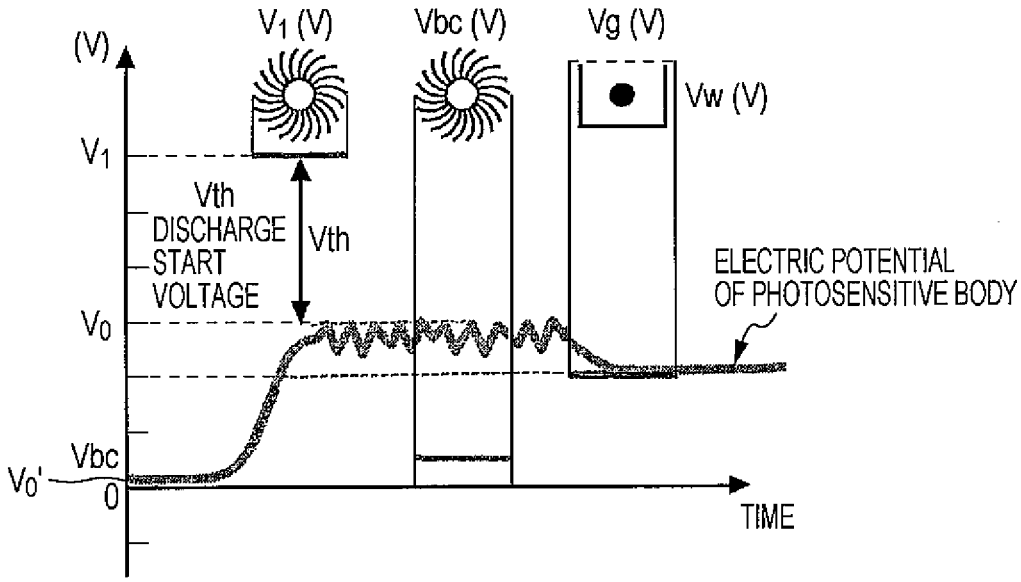
FIG. 2 is a diagram illustrating an electric potential of a photosensitive body.

When the image forming operation of the image forming apparatus 1 is started, the photosensitive body 2 is rotated, and the surface of the photosensitive body 2 is uniformly charged to a negative potential $V_0$ (V) (as shown in FIG. 2), which is set at the time of image formation, by the second charger 5 (the second charging process according to the aspect of the invention). Subsequently, the surface of the photosensitive body 2 is exposed by the exposure device 6, whereby an image is recorded thereon, and an electrostatic latent image having a low negative potential is formed on the photosensitive body 2 (the exposure process according to the aspect of the invention). The electrostatic latent image on the photosensitive body 2 is developed with the negatively charged toner by the developing device 7, and a toner image is formed on the photosensitive body 2 (the developing process according to the invention). The toner image on the photosensitive body 2 is transferred to a transfer medium 9 such as an intermediate transfer medium or a transfer material such as paper in a transfer process performed by the transfer device 8 (the transfer process according to the aspect of the invention). Similarly to existing image forming apparatus, the transfer medium 9 may be transfer material such as paper. In this case, a fixing unit not shown fixes the toner image, thereby forming a fixed image on the transfer material. In addition, the transfer medium 9 may be the intermediate transfer medium. In this case, the toner image, which is transferred onto the intermediate transfer medium, is additionally transferred onto the transfer material by a second transfer device (not shown in the drawing), and subsequently is fixed by the fixing unit as described above, thereby forming a fixed image on the transfer material.

As shown in FIG. 2, after termination of the transfer process, electricity of the photosensitive body 2 is removed by a discharger, which is not shown, and a surface potential of the photosensitive body 2 becomes an infinitesimally small voltage $V_0'$(V). In addition, after the termination of the transfer process, the transfer residual toner and external additive remain on the photosensitive body 2. Here, polarities of the transfer residual toner and external additive are not uniform. In addition, the surface of the photosensitive body 2 is approximately charged to the same negative potential (an electric potential obtained by subtracting Vth from $V_1$) as the toner used in the development process by the relatively large bias $V_1$ (V) of the first charger 3. Simultaneously, the transfer residual toner and external additive on the photosensitive body 2 are charged to a negative polarity (the first charging process according to the aspect of the invention). At this time, when the particle diameter of the external additive is significantly smaller than that of the toner, there is some external additive which comes into contact with the brush bristles 3*b* of the first brush roller 3*a*, and some external additive which does not come into contact with the brush bristles 3*b*. The external additive coming into contact with the brush bristles 3*b* becomes a high-charged external additive which has a high negative charge, and the external additive which does not coming into contact with the brush bristles 3*b* becomes a low-charged external additive which has a slight negative charge. Specifically, the high-charged external additive and the low-charged external additive exist in the external additive having passed the first charger 3.

Subsequently, by applying the cleaning bias Vbc (V) to the second brush roller 4*a*, an electric field is generated between the photosensitive body 2 and the second brush roller 4*a* (the cleaning process according to the aspect of the invention). Thereby, the second brush roller 4*a* electrostatically attracts the transfer residual toner and high-charged external additive which had remained on the surface of the photosensitive body 2 after the transfer process is terminated and had been charged by the first charger 3. Then, the attracted toner and high-charged external additive adhere to the brush bristles 4*b*. The toner and high-charged external additive adhered to the brush bristles 4*b* are electrostatically attracted by and adhere onto the collecting roller 4*c* to which the collecting bias Vrc (V) for generating a positive electric field opposite to that of the toner is applied. In addition, the toner and high-charged external additive adhered onto the collecting roller 4*c* are scraped off from the collecting roller 4*c* and collected by the cleaning blade 4*d*. Further, the low-charged external additive is not attracted by the second brush roller 4*a*, and directly passes (that is, leaks out of) the second brush roller 4*a* in the state where the additive is adhered onto the photosensitive body 2. At this time, the surface potential of the photosensitive body 2 slightly fluctuates in a wave-like manner.

Subsequently, the positive wire charging bias Vw (V) is applied to the charge wire 5*b* of the scorotron charger of the second charger 5, and the negative grid charging bias Vg (V) is applied to the grid 5*c*, and thus a positive bias is applied to the photosensitive body 2 from the second charger 5. In such a manner, the electric potential of the surface of the photosensitive body 2 is made to be uniform since the electric potential has a smaller charge in absolute value than the electric potential of the surface of the photosensitive body 2 generated after the surface passes the second brush roller 4*a*, and the photosensitive body surface potential is set to the electric potential $V_0$ (V) which is set at the time of image formation (the second charging process according to the aspect of the invention). In this case, since the surface potential of the photosensitive body 2 is required to be set to $V_0$ (V), it is difficult to set the bias, which is applied to the photosensitive body 2 from the second charger 5, to a large positive value. Accordingly, the low-charged external additive having passed the second charger 5 is not highly positively charged, and its electric potential becomes about 0 or has a slightly positive value. Then, the next image forming operation is performed.

Figure 3:
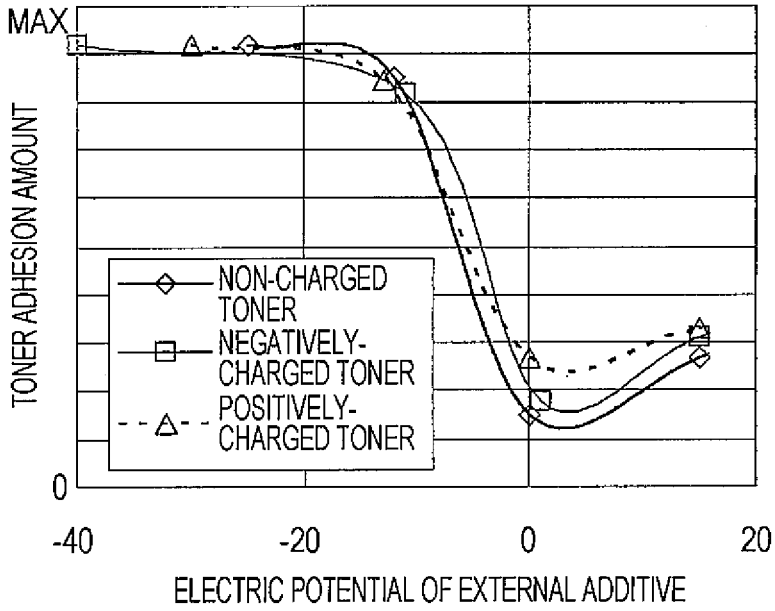
FIG. 3 is a diagram illustrating a relationship between an electric potential of an external additive and a toner adhesion amount.

In the next image forming operation, the low-charged external additive having passed the second charger 5 enters a developing area of the developing device 7. Generally, the external additive remaining on the part of the photosensitive body 2 on which the toner image had existed after transfer is free external additive released from the toner. When the free external additive is highly negatively charged by a charger, the toner adhesion force of the free external additive becomes strong, as shown in FIG. 3. Accordingly, the negatively charged free external additive attracts the toner in the developing area. As a result, the external-additive memory occurs. However, in the image forming apparatus 1 according to the example, the electric potential of the low-charged external additive having passed the second charger 5 becomes about 0 or a slightly positive value. Hence, the toner adhesion force of the external additive is weak, as shown in FIG. 3. Accordingly, the low-charged external additive does not attract the toner in the developing area in the next image forming operation. As a result, it is possible to prevent the occurrence of the external-additive memory.

It is preferred that the electric potential of the external additive having passed the second charger 5 ideally be 0. However, in order to make the electric potential of the external additive be 0, it is necessary to apply an alternating voltage (a superimposed voltage of DC and AC) to the wire of the corona charging or to individually perform positive corona charging and negative corona charging. This makes the configuration complex. In contrast, in the image forming apparatus 1 according to the example, the low-charged external additive is charged to only about 0 electric potential or a slightly positive electric potential by the second charger 5. Accordingly, the configuration is not complex.

The low-charged external additive on the photosensitive body 2 is transferred to the transfer medium 9 by the transfer device 8, and is removed from the photosensitive body 2. However, the low-charged external additive has no influence on the toner image transferred to the transfer medium 9, and thus excellent image quality of the toner image is maintained.

In the image forming apparatus 1 and the image forming method therefor according to the example, the transfer residual toner and external additive are negatively charged to the relatively large bias $V_1$ (V) by the first charger 3. In addition, the transfer residual toner and the high-charged external additive are removed by the cleaner 4 to which a relatively small bias Vbc (V) is applied. The low-charged external additive, which is not removed by the cleaner 4, is charged to about 0 or a slightly positive value by the second charger 5. In such a manner, the external additive having passed the second charger 5 has small toner adhesion force, and does not attract the toner in the developing area. As a result, it is possible to prevent the occurrence of the external-additive memory in the developing process, and thus it is possible to obtain stably high image quality.

Figure 4A:
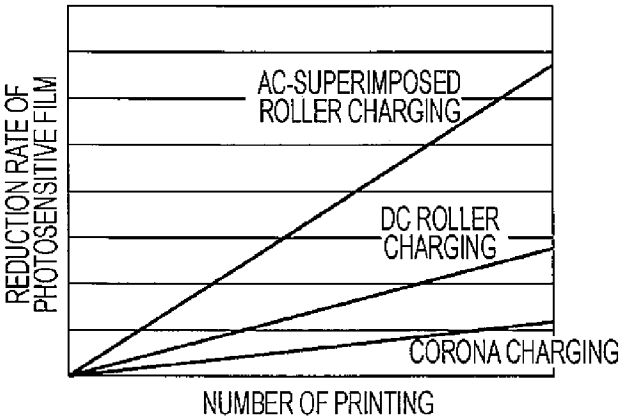
FIGS. 4A, 4B, 4C, and 4D are diagrams illustrating characteristics of different charging methods.
Figure 4B:
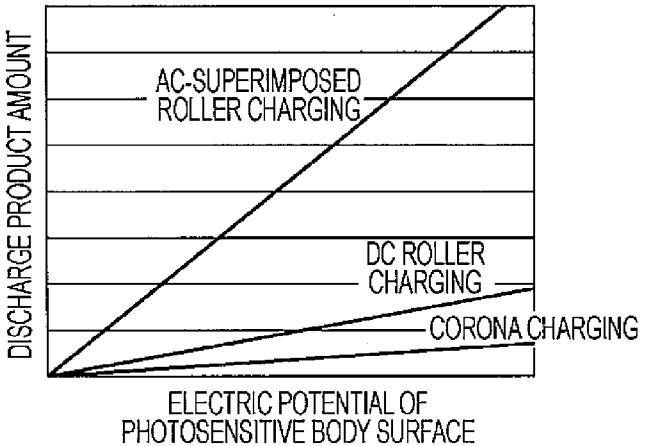

As shown in FIG. 4A, generally, the photosensitive body 2 may be charged by applying a bias of only a DC voltage to the charging roller. In this case, a film shaving amount of the photosensitive body 2 is smaller than that in the case of applying an AC voltage bias. The reason is that it is necessary to shave the deteriorated film formed on the photosensitive layer due to discharge stress which is caused by applying an AC voltage bias exceeding the discharge start voltage to the photosensitive body and the charging roller. In addition, as shown in FIG. 4B, the photosensitive body 2 may be charged by applying a bias of only a DC voltage to the charging roller. In this case, an amount of the discharge product is smaller than that in the case of applying an AC voltage bias. Accordingly, in this case, there is less deterioration of the photosensitive layer of the photosensitive body 2. In the image forming apparatus 1 according to the example, the bias of only a DC voltage is applied to either one of the first charger 3 and cleaner 4 by using the charging brush rollers 3*a* and 4*a* with a smaller rubbing force than a blade, thereby charging the photosensitive body 2. Accordingly, it is possible to suppress the deterioration and shaving of the photosensitive layer of the photosensitive body 2 caused by the photosensitive body charging of the first charger 3. In addition, it is also possible to suppress the deterioration and shaving of the photosensitive layer of the photosensitive body 2 caused by the photosensitive body cleaning of the cleaner 4. By adopting such a configuration, it is possible to effectively achieve long durability of the photosensitive body 2, and thus it is possible to obtain stably high image quality for a long period of time.

Figure 4C:
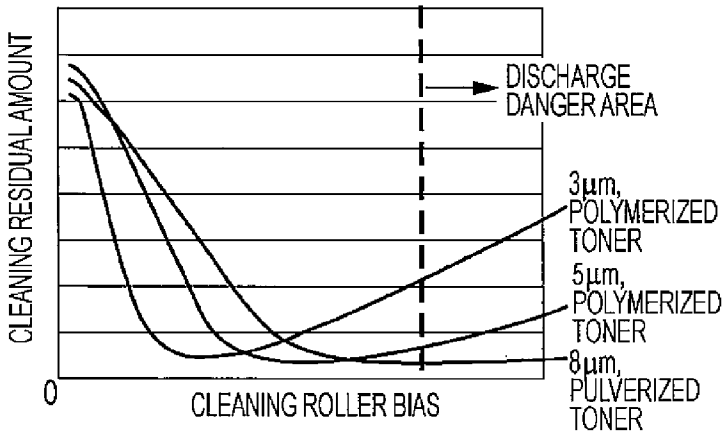

As shown in FIG. 4C, generally, it is possible to cope with cleaning various toners by controlling the cleaning bias which is applied to a cleaning member such as a cleaning roller. In this case, the cleaning effect is improved by increasing the cleaning bias as can be seen clearly from the drawing. However, when the cleaning bias becomes too large, it reaches the discharge danger area. Hence, the magnitude of the cleaning bias has limitation. In the image forming apparatus 1 according to the example, the cleaning bias vbc (V) is set to a bias having a magnitude which does not cause discharge between the brush bristles 4*b* and the surface of the photosensitive body 2, that is, which does not exceed the discharge limit. As a result, it is possible to more effectively remove the transfer residual toner and high-charged external additive on the photosensitive body 2.

Figure 4D:
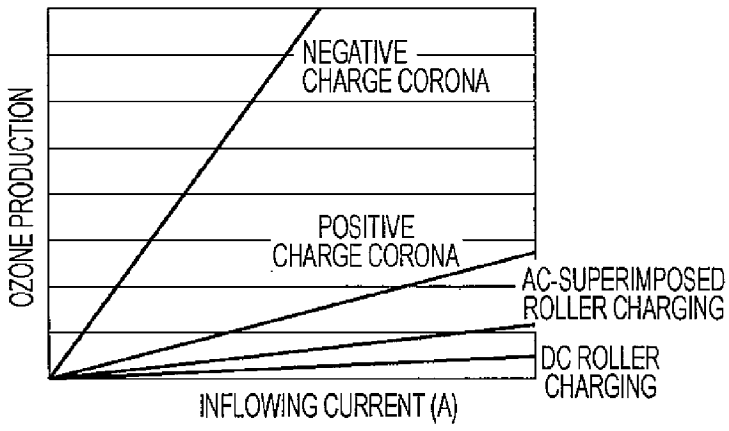

As shown in FIG. 4D, generally, ozone production is relatively large in the charging of the photosensitive body 2 which uses the corona charging. In this case, the ozone production particularly increases in the negative charging of the photosensitive body 2 which uses the corona charging. In the image forming apparatus 1 according to the example, mainly the photosensitive body 2 is highly negatively charged by the first brush roller 3*a* of the first charger 3, and the electric potential of the negatively charged photosensitive body 2 is decreased by a positive corona of the corona charger 5*a* in the second charger 5 used as an auxiliary, thereby making the electric potential of the photosensitive body uniform. Accordingly, in order to make the electric potential of the photosensitive body uniform, a corona charger may be used. Even in this case, since the change in charging potential thereof is small, it is possible to reduce the current of a charge wire, and thus it is possible to suppress ozone production. Moreover, a positive corona discharge can be performed by the corona charger 5*a*. Therefore, it is possible to perform uniform corona discharge since deterioration of the charge wire 5*b* is small when compared with the case where negative corona discharge is performed because of the difference in corona generation principal. As a result, it is possible to effectively achieve long durability of the second charger 5 and to obtain stably high image quality for a long period of time.

In addition, the photosensitive body 2, the transfer residual toner and external additive are highly negatively charged by the first charger 3. At this time, the high-charged external additive and the transfer residual toner are removed by the second brush roller 4*a*. In such a manner, the first brush roller 3*a* of the first charger 3 is used as the charging brush of the cleaner 4 for charging the toner and the external additive. By the dual use of the brush roller as described above, it is possible to achieve lower costs and space savings.

Next, the biases in the image forming apparatus 1 according to Examples 1 to 3 of the invention will be described. In all Examples 1 to 3, a color printer LP9000C (discharge start voltage Vth (V): −600 V) manufactured by Seiko Epson Co. is used.

Table 1 shows Example 1.

TABLE 1

| PROCESS | APPLIED BIAS | PHOTOSENSITIVE BODY SURFACE POTENTIAL |
|---|---|---|
| AFTER TRANSFER | | α: −30 V (REMOVAL OF ELECTRICITY) |
| FIRST CHARGER 3 | $V_1$: −1300 V | β: −700 V |
| SECOND BRUSH ROLLER 4a | Vbc: −300 V | γ: −700 V |
| SECOND CHARGER 5 | Vg: −450 V<br>Vw: +3.8 kV | δ: −450 V |

As shown in Table 1, in Example 1, electricity of the surface of the photosensitive body 2 is removed after transfer, the surface potential of the region a (shown in FIG. 1) of the photosensitive body 2 is −30 V. In addition, the first charging bias $V_1$ (V) of −1300 V, which is relatively high, is applied to the first brush roller 3*a* of the first charger 3. In such a manner, the photosensitive body 2 is negatively charged, and the surface potential of the region β (shown in FIG. 1) of the photosensitive body 2 is −700 V. Subsequently, the cleaning bias Vbc (V) of −300 V, which is relatively low, is applied to the second brush roller 4*a* of the cleaner 4. In this case, the discharge start voltage Vth (V) is −600 V. Therefore, the surface potential of the region y (shown in FIG. 1) of the photosensitive body 2 having passed the second brush roller 4*a* has not changed, and is still −700 V. Finally, the wire charging bias Vw (V) of +3.8 kV is applied to the charge wire 5*b* of the corona charger 5*a* of the second charger 5, and the grid charging bias Vg (V) of the −450 V is applied to the grid 5*c*. In such a manner, the photosensitive body 2 is charged by positive corona, and the surface potential of the region δ (shown in FIG. 1) of the photosensitive body 2 is reduced in absolute value, and is made uniform at −450 V. The electric potential of −450 V is the surface potential set at the time of normal image formation of the image forming apparatus 1.

Table 2 shows Example 2.

TABLE 2

| PROCESS | APPLIED BIAS | PHOTOSENSITIVE BODY SURFACE POTENTIAL |
|---|---|---|
| AFTER TRANSFER | | α: −350 V (NON REMOVAL OF ELECTRICITY) |
| FIRST CHARGER 3 | $V_1$: −1500 V | β: −900 V |
| SECOND BRUSH ROLLER 4a | Vbc: −700 V | γ: −900 V |
| SECOND CHARGER 5 | Vg: −450 V<br>Vw: +4.2 kV | δ: −450 V |

As shown in Table 2, in Example 2, electricity of the surface of the photosensitive body 2 was not removed after transfer, the surface potential of the region α of the photosensitive body 2 is −350 V. In addition, the first charging bias $V_1$ (V) of −1500 V, which is relatively high, is applied to the first brush roller 3*a* of the first charger 3. In such a manner, the photosensitive body 2 is negatively charged, and the surface potential of the region P of the photosensitive body 2 is −900 V. Subsequently, the cleaning bias Vbc (V) of −700 V, which is relatively low, is applied to the second brush roller 4*a* of the cleaner 4. In this case, the discharge start voltage Vth (V) is −600 V. Therefore, the surface potential of the region γ of the photosensitive body 2 having passed the second brush roller 4*a* has not changed, and is still −900 V. Finally, the wire charging bias Vw (V) of +4.2 kV is applied to the charge wire 5*b* of the corona charger 5*a* of the second charger 5, and the grid charging bias Vg (V) of the −450 V is applied to the grid 5*c*. In such a manner, the photosensitive body 2 is charged by positive corona, and the surface potential of the region δ of the photosensitive body 2 is reduced in absolute value, and is made uniform at −450 V. The electric potential of −450 V is the surface potential set at the time of normal image formation of the image forming apparatus 1.

Table 3 shows Example 3.

TABLE 3

| PROCESS | APPLIED BIAS | PHOTOSENSITIVE BODY SURFACE POTENTIAL |
|---|---|---|
| AFTER TRANSFER | | α: −350 V (NON REMOVAL OF ELECTRICITY) |
| FIRST CHARGER 3 | $V_1$: −1200 V | β: −600 V |
| SECOND BRUSH ROLLER 4a | Vbc: −100 V | γ: −600 V |
| SECOND CHARGER 5 | Vg: −450 V<br>Vw: +3.5 kV | δ: −450 V |

As shown in Table 3, in Example 3, electricity of the surface of the photosensitive body 2 was not removed after transfer similarly to Example 2, the surface potential of the region α of the photosensitive body 2 is −350 V. In addition, the first charging bias $V_1$ (V) of −1200 V, which is relatively high, is applied to the first brush roller 3*a* of the first charger 3. In such a manner, the photosensitive body 2 is negatively charged and the surface potential of the region β of the photosensitive body 2 is −600 V. Subsequently, the cleaning bias Vbc (V) of −100 V, which is relatively low, is applied to the second brush roller 4*a* of the cleaner 4. In this case, the discharge start voltage Vth (V) is −600 V. Therefore, the surface potential of the region γ of the photosensitive body 2 having passed the second brush roller 4*a* has not changed, and is still −600 V. Finally, the wire charging bias Vw (V) of +3.5 kV is applied to the charge wire 5*b* of the corona charger 5*a* of the second charger 5, and the grid charging bias Vg (V) of the −450 V is applied to the grid 5*c*. In such a manner, the photosensitive body 2 is charged by positive corona, and the surface potential of the region δ of the photosensitive body 2 is reduced in absolute value, and is made uniform at −450 V. The electric potential of −450 V is the surface potential set at the time of normal image formation of the image forming apparatus 1.

Next, the charging properties of various external additives and adhesion strength thereof to the toner will be described.

Figure 5:
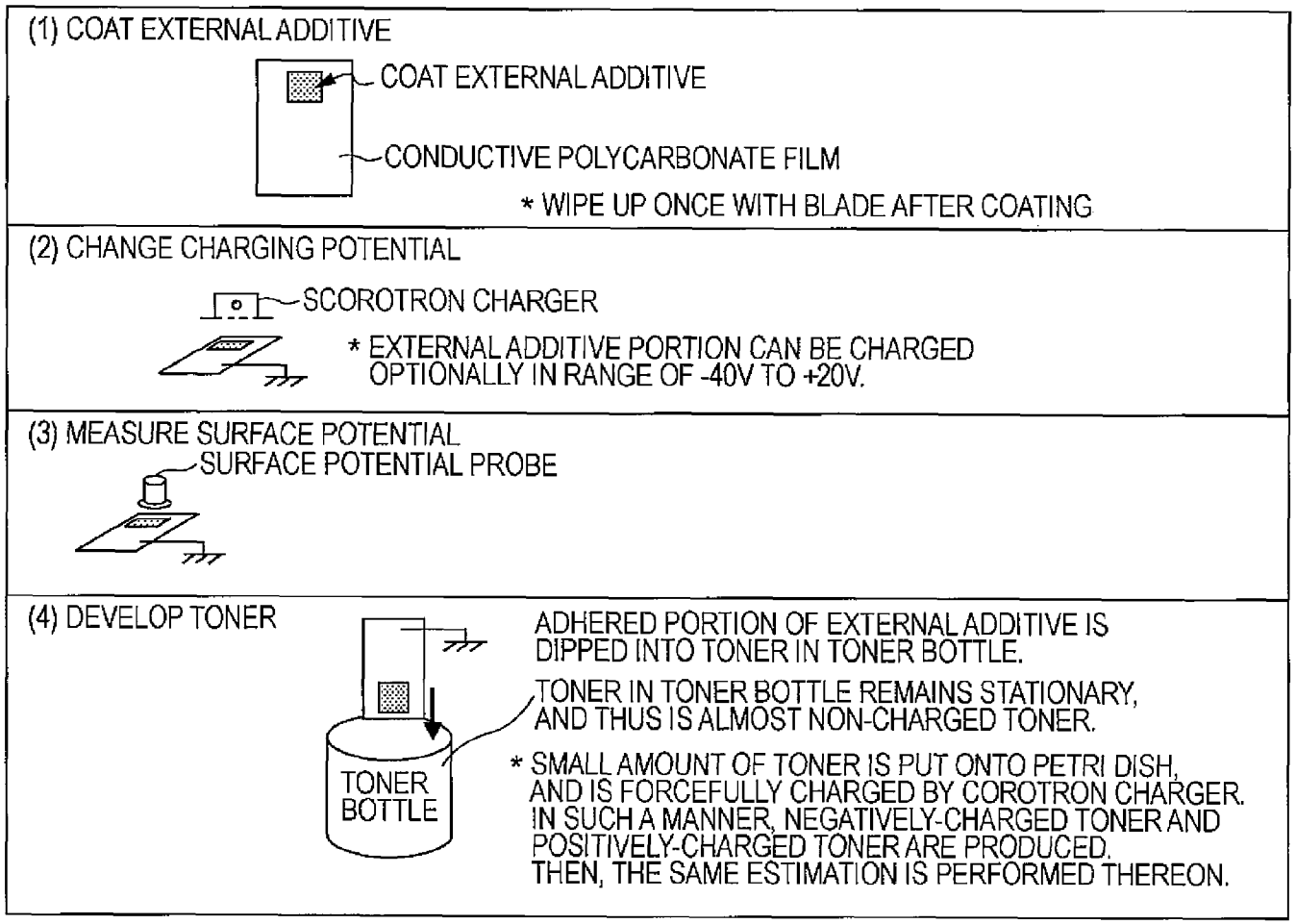
FIG. 5 is a diagram illustrating a method of measuring the electric potential of the external additive.

First, a method of measuring the electric potentials of the external additives will be described. As shown in FIG. 5, an external additive was coated on the conductive polycarbonate film. After the external additive was coated, the remaining external additive was wiped out once by the cleaning blade used in the LP9000C. Next, the portion on which the external additive was coated was charged by the scorotron charger. At this time, the external additive portion could be charged in the range of −40 V to +20 V by various changes to the charging potential of the scorotron charger. Next, the surface potential of the external additive portion was measured by a surface potential probe. Then, the coated portion of the external additive was dipped into toner in a toner bottle used in the LP9000C. At this time, the toner in the toner bottle remained stationary, and thus is toner which has almost no charge. Subsequently, the coated portion of the external additive was pulled up from the toner in the toner bottle. In such a manner, the toner was adhered onto the coated portion of the external additive.

The method of determining the charging property of the external additive is as follows. A wire current of the scorotron charger was set to ±100 μA, and the grid voltage was set to ±100 V. At this time, the external additive portions of samples are placed just below the wire, and their electric potentials were measured. When it was recognized that the electric potential has significantly changed, it was determined that the charging property of the external additive is good (O). When it was recognized that the electric potential has scarcely changed, it was determined that the charging property of the external additive is bad (×). When it was recognized that the electric potential was slightly changed when compared with above-mentioned significant change, it was determined that the charging property of the external additive is intermediate (Δ) which is neither good and nor bad.

In addition, the method of determining the toner adsorptive properties (toner adhesion strengths) of the external additives is as follows. When it was visually recognized that the adhesion amount of the toner adhered onto the coated portion of external additive was large in the case where the coated portion of the external additive was pulled up from the toner, it was determined that the adhesive property is good (O). In addition, when the adhesion amount of the toner was not so large or infinitesimally small, it was determined that the adhesive property is bad (×).

Table 4 shows types and determination results of the external additives.

TABLE 4

| | PARTICLE DIAMETER | PROCESS | CHARGING PROPERTY | TONER ADHESIVE PROPERTY IN NEGATIVE CHARGING | TONER ADHESIVE PROPERTY IN POSITIVE CHARGING |
|---|---|---|---|---|---|
| SILICA | 12 nm | HDMS | ○ | ○ | X |
| | 20 nm | HDMS | ○ | ○ | X |
| | 40 nm | HDMS | ○ | ○ | X |
| | 50 nm | HDMS | ○ | ○ | X |
| | 100 nm | HDMS | X | ○ | ○ * |
| | 12 nm | SILICON OIL | ○ | ○ | X |
| | 20 nm | SILICON OIL | ○ | ○ | X |
| | 40 nm | SILICON OIL | Δ | ○ | ○ * |
| | 50 nm | SILICON OIL | Δ | ○ | ○ * |
| | 100 nm | SILICON OIL | X | ○ | ○ * |
| +SILICA | 12 nm | SILANE COUPLING | Δ | X | X |

TABLE 4-continued

| | PARTICLE DIAMETER | PROCESS | CHARGING PROPERTY | TONER ADHESIVE PROPERTY IN NEGATIVE CHARGING | TONER ADHESIVE PROPERTY IN POSITIVE CHARGING |
|---|---|---|---|---|---|
| | 30 nm | SILANE COUPLING | X | X | X |
| | 50 nm | SILANE COUPLING | X | X | X |
| TITANIUM OXIDE | 14 nm | SILANE COUPLING | X | X | X |
| | 20 nm | SILANE COUPLING | X | X | X |
| | 30 nm | SILANE COUPLING | X | X | X |
| | 40 nm | SILANE COUPLING | X | X | X |
| | 50 nm | SILANE COUPLING | X | X | X |
| | 40 nm | SILICON OIL | X | X | X |
| RESIN BEAD (ACRYL) | 400 nm | | ○ | ○ | X |
| STRONTIUM TITANATE | | | X | X | X |
| ZINC OXIDE | | | X | X | X |
| CERIUM OXIDE | | | X | X | X |
| ALUMINA | | | X | X | X |
| ZINC STEARATE | | | X | X | X |
| MAGNESIUM STEARATE | | | X | X | X |

As shown in Table 4, the used external additive includes: negatively charged silica which is subjected to a HDMS treatment and has average volume particle diameters (hereinafter, it is simply referred to as a particle diameter) of 12 nm, 20 nm, 40 nm, 50 nm, and 100 nm; negatively charged silica which is subjected to a silicon oil treatment and has particle diameters of 12 nm, 20 nm, 40 nm, 50 nm, and 100 nm; positively charged silica which is subjected to a silane coupling treatment and has particle diameters of 12 nm, 30 nm, and 50 nm; titanium oxide which is subjected to the silane coupling treatment and has particle diameters of 14 nm, 20 nm, 30 nm, 40 nm, and 50 nm; titanium oxide which is subjected to the silicon oil treatment and has a particle diameter of 40 nm; resin bead (acryl) which is not subjected to a surface treatment and has a particle diameter of 400 nm; and the others, such as strontium titanate, zinc oxide, cerium oxide, alumina, zinc stearate, and magnesium stearate.

The determination results of the charging properties were as follows. The negatively charged silica which is subjected to the HDMS treatment and has the particle diameters of 12 nm, 20 nm, 40 nm, and 50 nm; the negatively charged silica which is subjected to the silicon oil treatment and has the particle diameters of 12 nm and 20 nm; and the resin bead (acryl) of the particle diameter of 400 nm were good. The negatively charged silica which is subjected to the silicon oil treatment and has the particle diameters of 40 nm and 50 nm; and the positively charged silica which is subjected to the silane coupling treatment and has the particle diameter of 12 nm were intermediate. All the other external additives were bad.

The determination results of the toner adhesive properties in the negative charging were as follows. All the negatively charged silica and the resin bead (acryl) of the particle diameter of 400 nm were good. All the other external additives were bad. On the other hand, the determination results of the toner adhesive properties in the positive charging were as follows. The negatively charged silica which is subjected to the HDMS treatment and has the particle diameter of 100 nm; and the negatively charged silica which is subjected to the silicon oil treatment and has the particle diameters of 40 nm, 50 nm, and 100 nm were good. All the other external additives were bad. Here, the sign * is added to the good sign (O) in the determination results of the toner adhesive properties in the positive charging. This means that toner adhesion was observed although charging properties of those were not so good. The reason may be that the toner adhesion is not electrostatic adhesion but physical adhesion. Accordingly, it is preferred that these external additives should not be used in the image forming apparatus according to the aspect of the invention. As can be seen from the above, it is apparent that toner adhesion force is generated in the case where the external additive having a good charging property is negatively charged, but the adhesion force is smaller in the case of positive charging. As a result, the external-additive memory can be reduced by the image forming apparatus according to the aspect of the invention.

Figure 6:
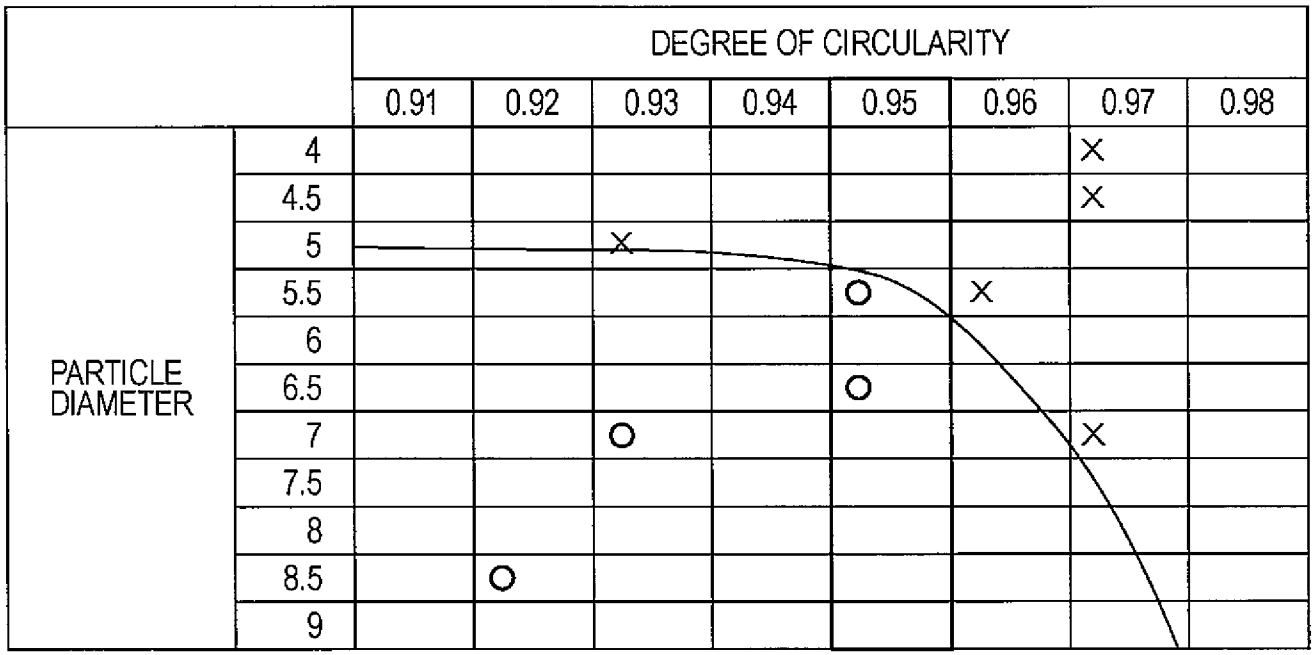
FIG. 6 is a diagram illustrating a particle diameter and a degree of circularity of a toner cleanable by a cleaning blade.

As shown in FIG. 6, toner that can be effectively removed by the cleaning blade is toner having an average volume particle diameter larger than 5 μm and a degree of circularity lower than 0.96. On the other hand, in order to obtain higher image quality, toner having a small particle diameter and a high degree of circularity is used. However, when toner having a small particle diameter and a high degree of circularity is used, the toner easily passes the cleaning blade. Hence, it is difficult to effectively clean the photosensitive body 2 by using a cleaning blade. For this reason, in the invention, the photosensitive body 2, the transfer residual toner and external additive are highly negatively charged by the first charger 3, and the high-charged external additive and the transfer residual toner are removed by the second brush roller 4*a*. In addition, the low-charged external additive, which is slightly charged, is positively charged by the second charger 5, and thus an electric potential of the low-charged external additive is charged to about 0 or a slightly positive value while the electric potential of the photosensitive body 2 is reduced in absolute value and is made uniform. In such a manner, even when using toner having a small particle diameter equal or less than 5 μm and a high degree of circularity equal to or more than 0.96, it is possible to suppress the influence of the transfer residual external additive on image quality, that is, the external-additive memory, while effectively removing the transfer residual external additive. As a result, it is possible to obtain higher image quality.

As described above, the following facts are apparently observed. The image forming apparatus according to the aspect of the invention may be applied to an image forming apparatus using negatively charged toner like negatively charged silica having a relatively small particle diameter. In this case, it is possible to effectively achieve reduction in memory of the transfer residual external additive, long durability of the photosensitive body 2 and the second charger 5, and suppression in ozone production.

Furthermore, the above-mentioned relationship between the adhesion amounts of the external additive and the toner shown in FIG. 3 shows the measurement results of the silica which is subjected to the HDMS treatment and has the particle diameter of 12 nm in Table 4. Further, in FIG. 3, a small amount of toner is taken from the toner bottle and placed on the petri dish as shown in FIG. 5, and the corotron charger performs compulsory charging thereon, thereby producing the negatively-charged toner and the positively-charged toner.

The entire disclosure of Japanese Patent Application No. 2008-182265, filed Jul. 14, 2008 is expressly incorporated by reference herein.

What is claimed is:

1. An image forming apparatus comprising:

an image carrier that is rotatably formed and carries a latent image formed thereon;

an exposure device that forms the latent image on the image carrier;

a developing device that develops the latent image on the image carrier by using a toner charged to a predetermined polarity and having an external additive;

a transfer device that transfers a toner image developed on the image carrier to a transfer medium;

a first charging member that charges the external additive and the transfer residual toner remaining on the image carrier and the image carrier after transfer to the same polarity as a polarity of the toner;

a cleaning member that electrostatically attracts the external additive and the transfer residual toner charged by the first charging member to the same polarity as the polarity of the toner; and a second charging member that charges the image carrier to an electric potential smaller in absolute value than an electric potential of the image carrier generated after the image carrier passes the cleaning member, wherein the cleaning member is charged to the same polarity of the toner and electrostatically attracts the external additive and the transfer residual toner by an electronic field between the charged image carrier and the cleaning member.

2. The image forming apparatus according to claim 1, wherein the first charging member is a first brush roller.

3. The image forming apparatus according to claim 2, wherein the cleaning member is a second brush roller.

4. The image forming apparatus according to claim 3, further comprising:

a collecting roller that electrostatically attracts the toner, which is adhered to the second brush roller, from the second brush roller; and a cleaning blade that removes the toner from the collecting roller.

5. The image forming apparatus according to claim 1, wherein the second charging member is a corona charger.

6. The image forming apparatus according to claim 5, wherein the corona charger is a scorotron charger.

7. The image forming apparatus according to claim 1, wherein a volume average particle diameter of the toner is 5 um or less.

8. The image forming apparatus according to claim 1, wherein a degree of circularity of the toner is 0.96 or more.

9. An image forming method comprising:

a first charging process of charging an external additive and a transfer residual toner remaining on an image carrier and the image carrier after transfer to the same polarity as a polarity of a toner;

a cleaning process of cleaning the image carrier using a cleaning member by electrostatically attracting the external additive and the transfer residual toner on the image carrier charged in the first charging process to the same polarity as the polarity of the toner, a second charging process of charging the image carrier to an electric potential smaller in absolute value than an electric potential of the cleaned image carrier;

an exposure process of forming a latent image on the image carrier of which the electric potential is adjusted in the second charging process;

a developing process of developing the latent image on the image carrier so as to form a toner image by using the toner charged to a predetermined polarity; and a transfer process of transferring the toner image on the image carrier to a transfer medium, wherein the cleaning member is charged to the same polarity as the polarity of the toner and electrostatically attracts the external additive and the transfer residual toner by an electronic field between the charged image carrier and the cleaning member.

* * * * *